US009926165B2

(12) United States Patent
Chen

(10) Patent No.: US 9,926,165 B2
(45) Date of Patent: Mar. 27, 2018

(54) ADHESIVE TAPE DISPENSER

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 2 days.

(21) Appl. No.: 15/137,213

(22) Filed: Apr. 25, 2016

(65) Prior Publication Data

US 2017/0305705 A1 Oct. 26, 2017

(51) Int. Cl.
*B65H 35/00* (2006.01)

(52) U.S. Cl.
CPC ..... *B65H 35/0033* (2013.01); *B65H 35/0073* (2013.01); *B65H 2301/41421* (2013.01); *B65H 2301/5132* (2013.01); *Y10T 156/1365* (2015.01); *Y10T 156/1795* (2015.01); *Y10T 225/269* (2015.04)

(58) Field of Classification Search
CPC .... A61B 17/064; D02G 3/34; Y10T 225/268; Y10T 156/1365; Y10T 225/282; Y10T 225/257; B65H 2301/5132; B65H 2301/41421; B65H 35/33; B65H 35/0073
USPC ..... 225/66
See application file for complete search history.

(56) References Cited

U.S. PATENT DOCUMENTS 5,954,916 A * 9/1999 Orlandi ..... B41F 17/13 156/385
7,669,631 B2 * 3/2010 Bailey ..... B65H 35/0033 156/523
7,712,505 B2 * 5/2010 Yamada ..... B65H 35/0033 156/443
2015/0336761 A1 * 11/2015 Clayson ..... B65H 18/28 156/527

FOREIGN PATENT DOCUMENTS

JP 2003054826 A * 2/2003 ..... B65H 35/07

* cited by examiner

*Primary Examiner* — Laura M Lee
(74) *Attorney, Agent, or Firm* — Ming Chow; Sinorica, LLC

(57) ABSTRACT

An adhesive tape dispenser includes a main body provided with a flattening sheet at an upper side of a first end and the flattening sheet is connected with a blade. The main body is provided with a Velcro at an underside of the first end and pivotally mounted with a first roller corresponding with the Velcro. In the process of release of adhesive tape, the adhesive tape enables the first roller and the Velcro to rub each other and generates static electricity and thus, when the adhesive tape is not used, the adhesive tape will be absorbed to the first roller and impossible to roll up back to the adhesive tape roll.

12 Claims, 7 Drawing Sheets

ADHESIVE TAPE DISPENSER

BACKGROUND OF THE INVENTION

1. Field of the Invention

This invention relates to an adhesive tape dispenser, particularly to one convenient in release of the adhesive tape.

2. Description of the Prior Art

A conventional adhesive tape dispenser includes a main body formed with a first end and a second end. The main body has the first end pivotally provided with a flattening sheet, having a roller positioned under the flattening sheet and a blade inserted between the flattening sheet and the roller. The main body has the second end provided with a handle and the interior mounted with a fixed shaft between the first end and second end. In using, a tape roll is first fitted on the fixed shaft and the tape of the tape roll is pulled out to pass round the roller and then continues to be pulled until the tape reaches to the flattening sheet. At this time, a user can hold the handle to release the tape for use and, after the tape is flattened out by the flattening sheet and adheres to the article to be pasted, the tape is cut off by the blade. However, when the conventional adhesive tape dispenser is not in use, the tail end of the tape is apt to roll up back and stick to the outer surface of the tape roll so it is hard for a user to find the tail end of the tape when the tape is to be used, thus resulting in convenient in use of the conventional adhesive tape disposer. Therefore, having observed the drawback mentioned above, the inventor of this invention thinks that the conventional adhesive tape dispenser is necessary to be improved and hence devises this invention.

SUMMARY OF THE INVENTION

The objective of this invention is to offer an adhesive tape dispenser that is safe and convenient in use.

The adhesive tape dispenser in the present invention includes a main body having a first end provided with a tape release portion received therein with an electrostatic generating element. An electrostatic bearing element is disposed in the tape release portion, able to rub together with the electrostatic generating element. A tape holder is positioned in the main body and provided with a reel, and a blade is mounted in the main body.

The tape holder of the adhesive tape dispenser of this invention is installed thereon with a tape roll able to release tape. In the process of release of tape, the tape enables the electrostatic bearing element and the electrostatic generating element to rub each other and generate static electricity to be stored by the electrostatic bearing element. Thus, the tape can be absorbed by the electrostatic bearing element and impossible to roll up back to the tape roll, convenient in use.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
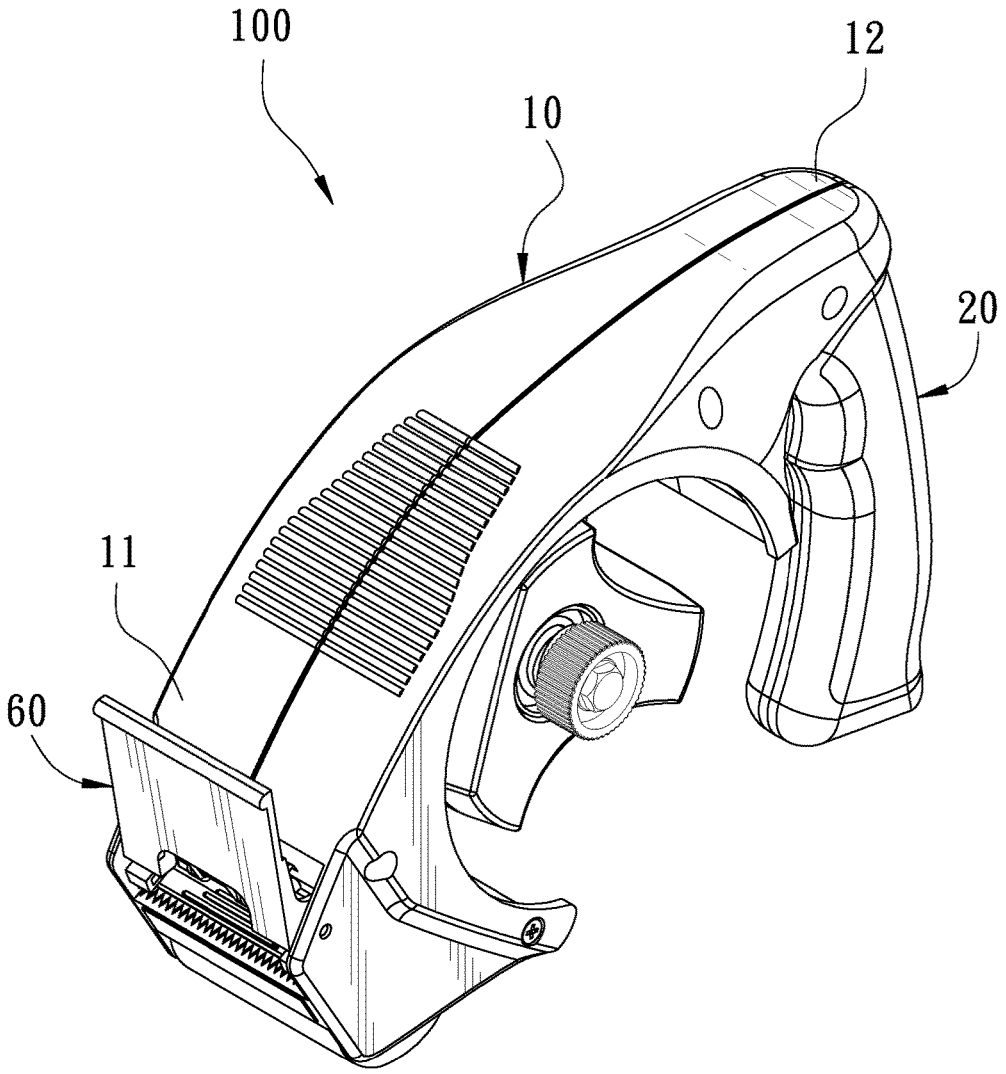
FIG. 1 is a perspective view of an adhesive tape dispenser in the present invention.

A preferred embodiment of an adhesive tape dispenser 100 in the present invention, as shown in FIGS. 1-4, includes a main body 10, a holding portion 20, a tape holder 30, an electrostatic bearing element 40, a second roller 50, a flattening sheet 60, a blade box 70 and a blade 80 as main components combined together.

The main body 10 is formed with a first end 11 and a second end 12. The first end 11 of the main body 10 has an underside provided with a tape release portion 13, which is a first accommodating groove, and an electrostatic generating element 14 is fixed at the groove wall of the first accommodating groove. The main body 10 consists of a first cover 15 and a second cover 16 provided oppositely. In this invention, the first end 11 of the main body 10 has an upper side formed with a second accommodating groove 17, which has two side walls respectively and transversely disposed with a first position-limiting block 171, with a first position-limiting groove 172 formed between the first position-limiting blocks 171 and the bottom of the second accommodating groove 17. Further, the first cover 15 is provided with a long arcuate second position-limiting block 151 facing the second cover 16 at an intermediate position of the first end 11 and the second end 12, and the second position-limiting block 151 is formed with a second position-limiting groove 152 at a location facing the first end 11 and has a positioning rod 18 inserted through one end adjacent to the topside of the main body 10. Furthermore, the first cover 15 has the second end 12 provided with at least one round rod 153 facing the second cover 16 and respectively bored with a first fixing hole 154, and the second cover 16 has the second end 12 provided with a second round rod 161 corresponding with the first round rod 153 and respectively bored with a second fixing hole 162 corresponding to the first fixing hole 154. In addition, the external diameter of the second round rod 161 is larger than that of the first round rod 153, and the second round rod 161 is formed with a recessed groove 163 corresponding to the first round rod 153 to enable the second round rod 161 to be fitted with the first round rod 153.

The holding portion 20 is secured at the second end 12 of the main body 10 and positioned between the first cover 15 and the second cover 16. The holding portion 20 consists of a grip 21, which is hollow and which is bored with a third insert hole 211 corresponding to the first round rod 153 at one side adjacent to the first cover 15 for the first round rod 153 to be inserted therein. The grip 21 is further bored with a fourth insert hole 212 corresponding to the second round rod 161 at one side adjacent to the second cover 16 for the second round rod 161 to be inserted therein. A screw member 300 is inserted through both the fourth insert hole 212 and the third insert hole 211 and screwed with the fixing hole 154 of the first round rod 153 of the first cover 15 to have the second round rod 161 secured with the first round rod 153 for firmly combining the holding portion 20 together with the main body 10.

The tape holder 30 received in the main body 10 is provided with a first shaft lever 31 and a second shaft lever 32 spaced apart. The tape holder 30 is further provided with a resisting block 33 at a location adjacent to the first shaft lever 31. A second elastic member 34, which is a torsional spring, is fitted around the first shaft lever 31, having a fixed end 342 resisting against the main body 10 and an elastic end 342 resisting against the resisting block 33, and a reel 35 is fitted on the second shaft lever 32. The tape holder 30 is provided with a position-limiting sheet 36 corresponding to the second position-limiting groove 152 at a location adjacent to the second shaft lever 32, and the position-limiting sheet 36 is cut with a notch 361 corresponding with the positioning rod 18 for engaging the positioning rod 18 therein and positioning the tape holder 30.

The electrostatic bearing element 40 is pivotally fixed in the tape release portion 13, able to rub together with the electrostatic generating element 14. In this invention, the electrostatic bearing element 40 is made of thermoplastic rubber (TPR) and the electrostatic bearing element 40 is a first roller.

The second roller 50 is pivotally fixed with both the first cover 15 and the second cover 16 and positioned between the reel 35 and the electrostatic bearing element 40.

The flattening sheet 60 is pivotally installed at an upper side of the first end 11, including a sheet body 61 formed with a pivot joint portion 611, which is two pivot joint blocks respectively bored with a pivot joint slot 612, and a transverse fixed shaft 62 is pivotally connected with the two pivot joint slots 612. The external diameter of the fixed shaft 62 is a little larger than the opening width of the pivot joint slot 612, and the fixed shaft 62 has two ends respectively fixed with two side walls of the second accommodating groove 17, and the first position-limiting blocks 171 are positioned between the fixed shaft 62 and the bottom of the second accommodating groove 17. Further, the fixed shaft 62 is fitted thereon with a first elastic member 63, which is a torsional spring, and the first elastic member 63 has a fixed end 631 resisting against the main body 10 and an elastic end 63 pushing against the sheet body 61 to enable the sheet body 61 to be turned pivotally with the fixed shaft 62 serving as an axis. The sheet body 61 is further provided with an interacting block 613 respectively at the locations of the pivot joint blocks.

The blade box 70 is assembled at the pivot joint portion 611 of the flattening sheet 60 and in this invention, the blade box 70 is bored with two first insert holes 71 corresponding with the two interacting blocks 613 for the interacting blocks 613 to be inserted therein.

The blade 80 fixed with the blade box 70 is bored with two second insert holes 81 corresponding to the interacting blocks 613. Thus, the interacting blocks 613 can be orderly inserted in the first insert holes 71 and the second insert holes 81, and the sheet body 61 can actuate both the blade box 70 and the blade 80 to move via the interacting blocks 613.

Figure 2:
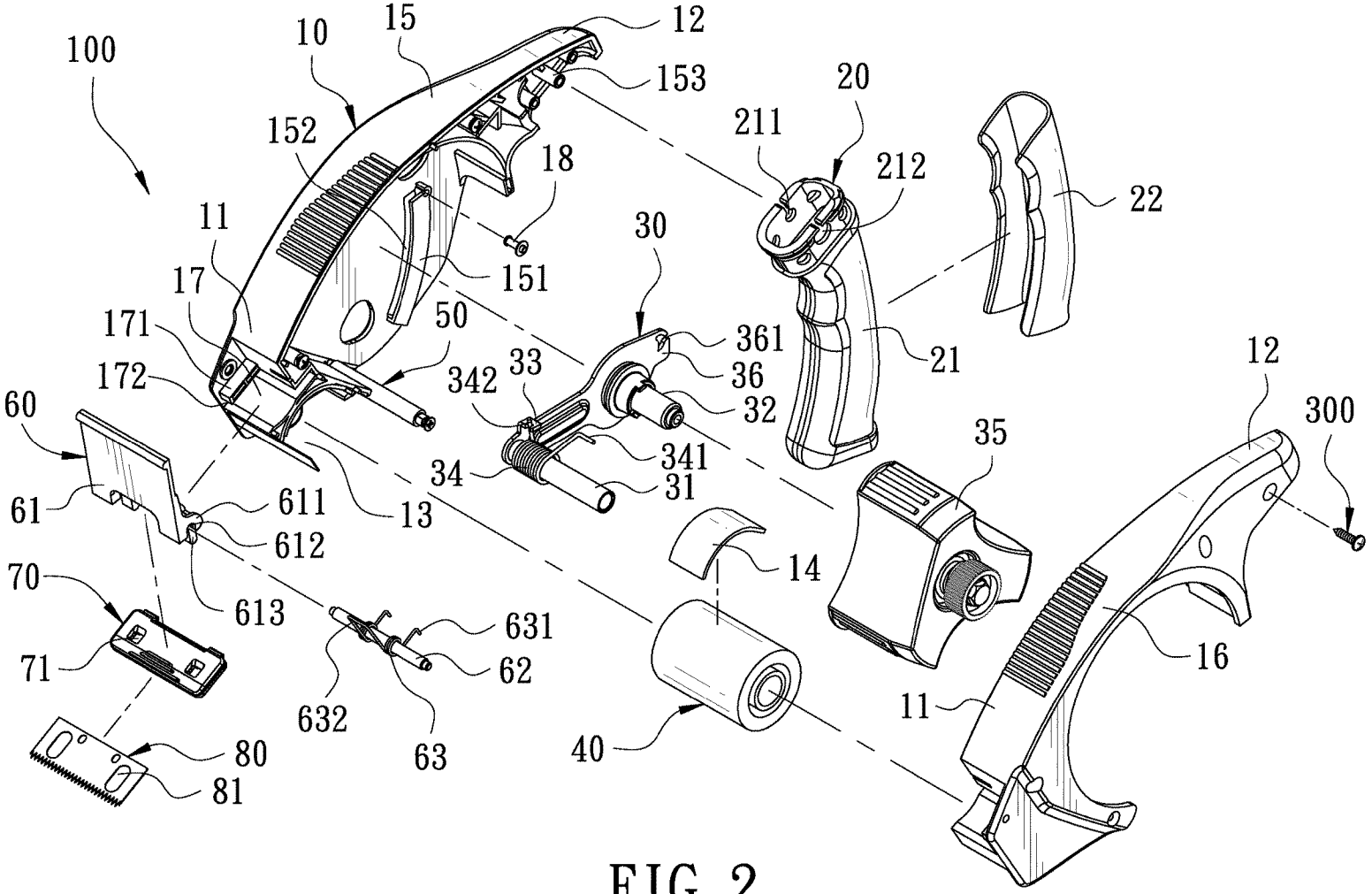
FIG. 2 is an exploded perspective view of the adhesive tape dispenser in the present invention.
Figure 3:
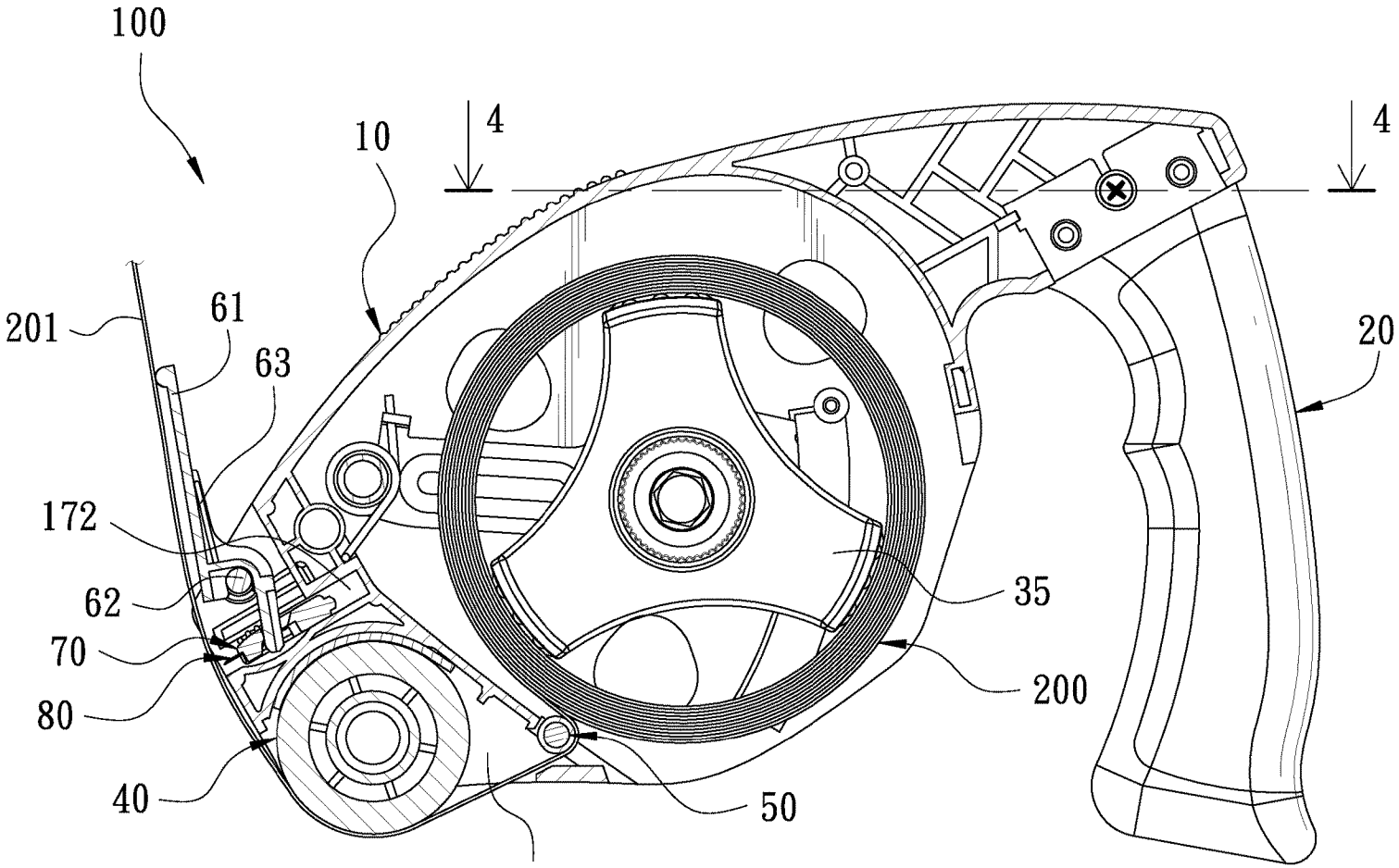
FIG. 3 is a cross-sectional view of the adhesive tape dispenser in the present invention, showing installation of a tape roll.
Figure 5:
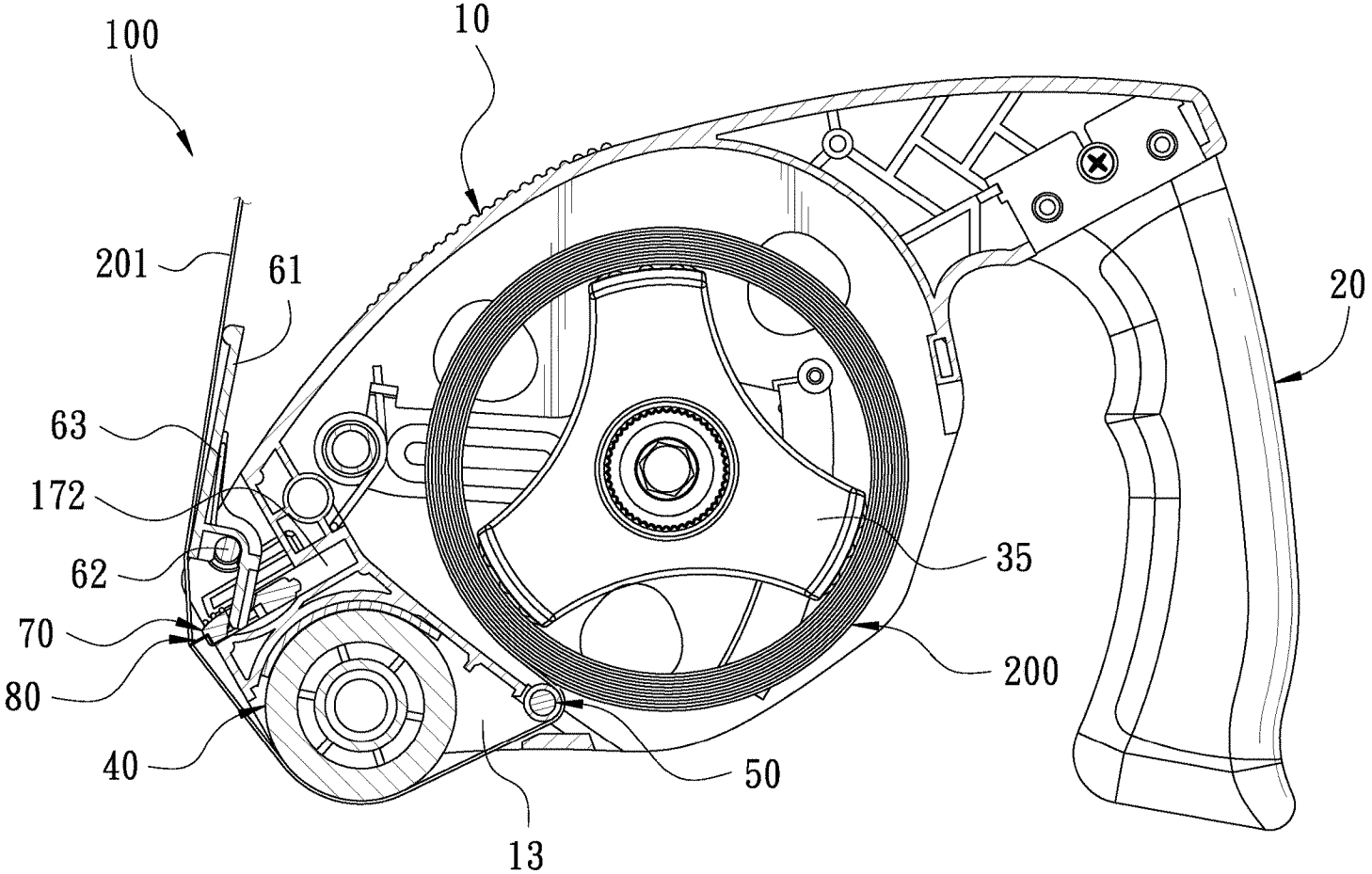
FIG. 5 is a schematic view of the adhesive tape dispenser in use in the present invention, showing that the tape is flattened out and cut off.

Referring to FIGS. 3 and 5 as well as FIG. 2, when the adhesive tape dispenser 100 is to be used, a tape roll 200 is first fitted on the reel 35 and the tape 201 of the tape roll 200 is pulled out to pass round the outer side of the second roller 50 and further pass round the outer side of the electrostatic bearing element 40 and then, the tape 201 continues to be pulled to reach one side of the sheet body 61. At this time, a user can grasp the holding portion 20 to have the tape 201 adhering to an article to be pasted and release the tape 201 for use. To cut off the tape 201, simply push the sheet body 61 toward the article to be pasted to make the sheet body 61 turn pivotally along the fixed shaft 62 and meanwhile actuate the blade box 70 to move outward from the first position-limiting grooves 172 and stretch out the blade 80 to cut off the tape 201. After the tape 201 is cut off, the first elastic member 63 will elastically push the sheet body 61 to have both the blade case 70 and the blade 80 retracted. Thus, under normal condition, the blade 80 of the adhesive tape dispenser 100 is retracted in the main body 10, able to prevent the blade 80 from cutting and injuring human body for enhancing safety in use of the adhesive tape dispenser 100.

Figure 6:
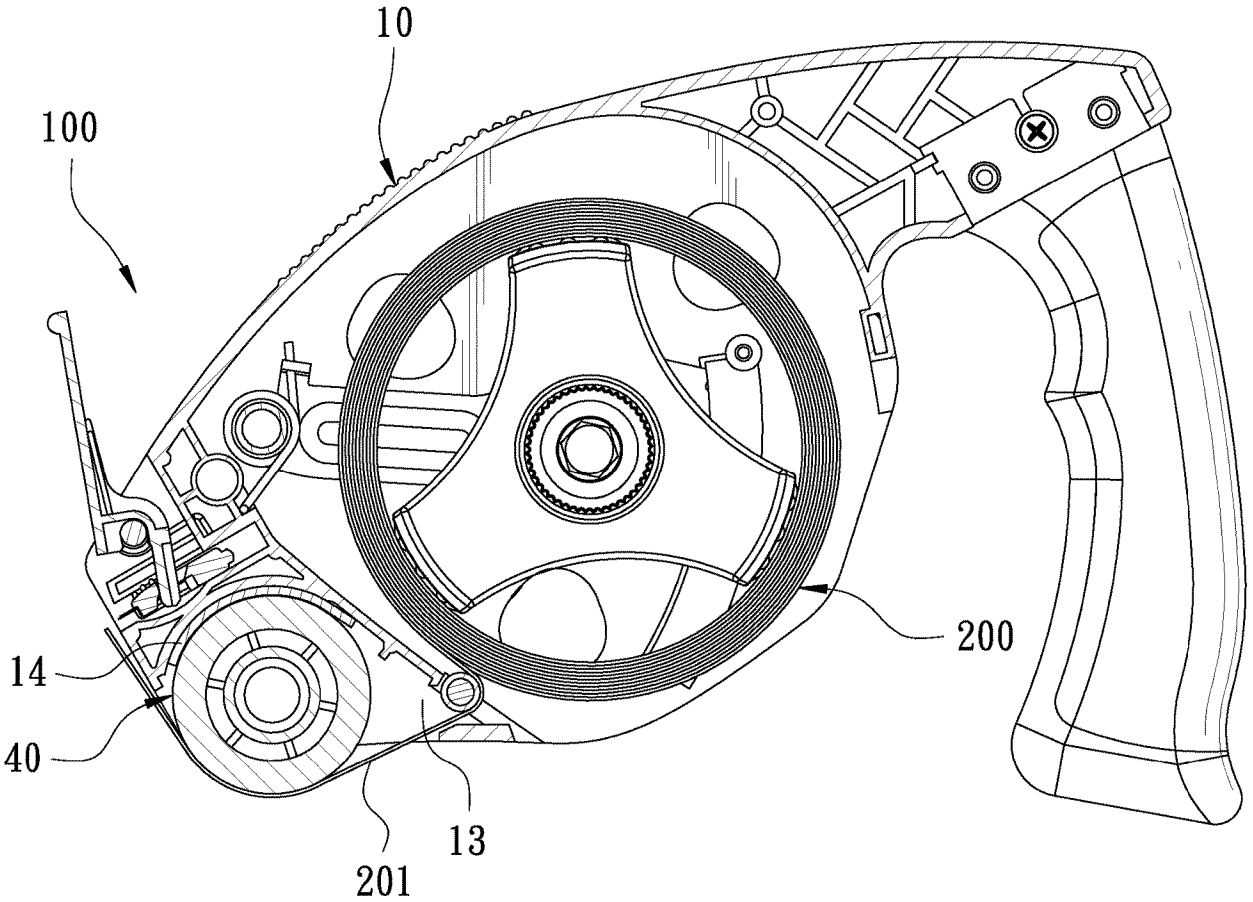
FIG. 6 is a schematic view of the adhesive tape dispenser in the present invention, showing that the tape is absorbed onto a first roller.

Referring to FIG. 6, since the tape release portion 13 is provided therein with the electrostatic generating element 14; therefore, under operating condition, the electrostatic bearing element 40 will be rotated, and the tape 201 will make the electrostatic bearing element 40 and the electrostatic generating element 14 rub each other and generate static electricity, thus enabling the tape 201 to be absorbed onto the electrostatic bearing element 40 and impossible to be rolled up back to the tape roll 200. Thus, this invention is convenient in use.

In this invention, the electrostatic generating element 14 is hair fiber with a certain length and also can be a Velcro, and the electrostatic bearing element 40 is made of thermoplastic rubber (TPR), advantageous to generation and bearing of the static electricity.

Figure 4:
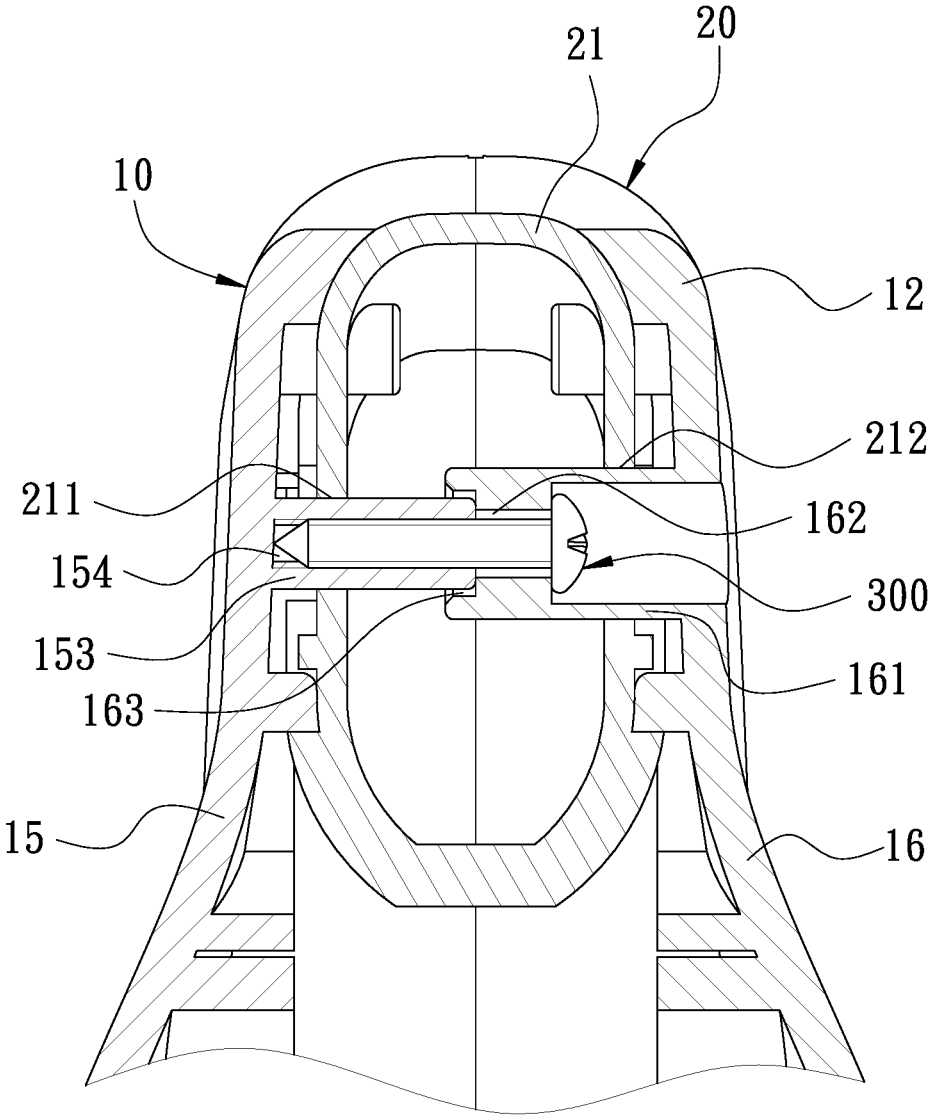
FIG. 4 is a cross-sectional view of the line 4-4 in FIG. 3.
Figure 7:
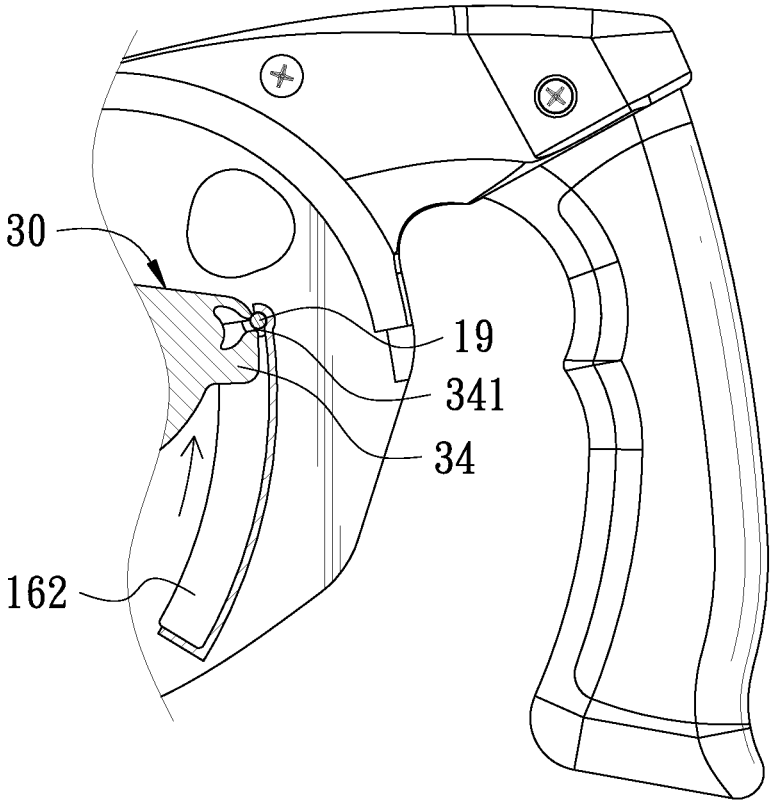
FIG. 7 is a schematic view of the adhesive tape dispenser in use in the present invention, showing replacement of a tape roll.

Referring to FIGS. 2 and 4, when the adhesive tape dispenser 100 releases the tape 201, the tape holder 30 is restrictedly positioned in the second position-limiting groove 152 via the position-limiting sheet 36, and the resisting block 33 is resisted by the second elastic member 34; therefore, the tape holder 30 has pre-stress toward the second roller 50 to enable the reel 35 and the tape roll 200 to rest against the second roller 50 and further fix the tape holder 30 in place and thus lowering the noise caused by release of the tape 201 and attaining effect of noiselessness. To replace the tape roll 200, referring to FIG. 7, only push the tape holder 30 upward to actuate the position-limiting sheet 36 to move upward along the second position-limiting groove 152 to have the notch 361 engaged with the positioning rod 18. Thus, the tape holder 30 can be fixed in position and the tape roll 200 can be replaced.

Referring to FIG. 4, one of the special features of this invention is that the second round rod 161 is larger than the first round rod 153 in diameter, and the second round rod 161 is provided with the recessed groove 163 corresponding with the first round rod 153. Thus, after the first round rod 153 and the second round rod 161 are respectively inserted through the third insert hole 211 and the fourth insert hole 212, the second round rod 161 can be fitted with the first round rod 153 and then, the screw member 300 is inserted through the second fixing hole 162 and the first fixing hole 154 to combine the second round rod 161 together with the first round rod 153 and also have the first cover 15, the second cover 16 and the holding portion 20 fixed in position. Therefore, this invention is simple and convenient in assembly and easy in manufacturing. In addition, the grip 21 has its outer side fitted with an outer shell 22, as shown in FIG. 2 and, different from the grip 21, the outer shell 22 is made of an anti-skid material, able to enhance skid resistance of the holding portion 20 and letting the holding portion 20 present a bi-colored pattern for beautifying the holding portion 20.

Another special feature of this invention is that the flattening sheet 60 can be actuated by the fixed shaft 62 and the first elastic member 63 and the interacting blocks 613 to make both the blade box 70 and the blade 80 to stretch out or retract along the first positioning-limiting groove 172. Since the external diameter of the fixed shaft 62 is a little large than the opening width of the pivot joint slots 612; therefore, when the blade 80 is to be replaced, a user can quickly disassemble the flattening sheet 60 and withdraw the blade box 70 and the blade 80 for replacing the blade 80 with a new one, thus attaining effects of fast stretching and retracting of the blade box 70 and quick replacement of the blade 80.

While the preferred embodiment of the invention has been described above, it will be recognized and understood that various modifications may be made therein and the appended claims are intended to cover all such modifications that may fall within the spirit and scope of the invention.

What is claimed is:

1. An adhesive tape dispenser comprising:
a main body;
the main body comprising a first end, a second end and a tape release portion;
the first end and the second end being located opposite to each other along the main body;
the tape release portion being formed at the first end;
an electrostatic generating element;
the electrostatic generating element being received in the tape release portion;
an electrostatic bearing element;
the electrostatic bearing element being received in the tape release portion;
the electrostatic bearing element and the electrostatic generating element being configured to rub against each other;
a tape holder;
the tape holder being assembled in the main body;
the tape holder comprising a reel;
the reel being configured to receive a tape roll having a tape;
a blade;
the blade being installed in the main body;
the electrostatic bearing element and the electrostatic generating element generating a static electricity to be stored upon the electrostatic bearing element by the electrostatic bearing element and the electrostatic generating element rubbing against each other;
the tape being attracted onto the electrostatic bearing element in response to the static electricity being generated;
the main body comprising a first accommodating groove;
the first accommodating groove being formed on the tape release portion;
the first accommodating groove comprising a first groove wall;
the electrostatic generating element being fixed to the first groove wall;
the electrostatic bearing element comprising a first roller;
the first roller being pivotally received in the first accommodating groove; and
the electrostatic bearing element and the electrostatic generating element generating the static electricity to be stored upon the electrostatic bearing element by the first roller rotating to rub the electrostatic generating element.

2. The adhesive tape dispenser as claimed in claim 1 comprising:
the main body comprising a second accommodating groove;
the second accommodating groove being formed at the first end;
the second accommodating groove comprising two second groove walls, two first position-limiting blocks and a groove bottom;
the two first position-limiting blocks being located in between the two second groove walls;
the groove bottom being located in between the two first position-limiting blocks;
the blade being received in the second accommodating groove;
the blade being located in between the two first position-limiting blocks and the groove bottom;
a flattening sheet;
the flattening sheet comprising a sheet body, a fixed shaft and a first elastic member;
the sheet body comprising a pivot joint portion and an interacting block;
the pivot joint portion being pivotally connected with the fixed shaft;
the fixed shaft comprising a shaft end;
the shaft end being fixed to one of the two second groove walls;
the two first position-limiting blocks being located in between the fixed shaft and the groove bottom;
the first elastic member being fitted on the fixed shaft;
the first elastic member comprising a first fixed end and a first elastic end;
the first fixed end pressing against the main body;
the first elastic end pressing against the sheet body;
the sheet body being configured to be actuated to turn pivotally with the fixed shaft acting as an axis;
the interacting block being disposed on the pivot joint portion; and
the interacting blocks being inserted into the blade.

3. The adhesive tape dispenser as claimed in claim 2 comprising:
the pivot joint portion comprising a pivot joint block and a pivot joint slot;
the pivot joint slot being formed on the pivot joint block;
the fixed shaft being pivotally inserted into the pivot joint slot;
the interacting block being disposed on the pivot joint block;
a blade box;
the blade box being received in the first position-limiting groove;
the blade being mounted on the blade box;
the blade box comprising a first insert hole;
the first insert hole corresponding to the interacting block;
the blade comprising a second insert hole;
the second insert hole corresponding to the interacting block;
the interacting block being inserted into the first insert hole and the second insert hole; and
the sheet body being configured to be actuated to move together with the blade case and the blade.

4. The adhesive tape dispenser as claimed in claim 3 comprising:
the fixed shaft comprising a shaft diameter;

the pivot joint slot comprising a slot diameter; and
the shaft diameter being larger than the slot diameter.

5. The adhesive tape dispenser as claimed in claim 2 comprising:
the tape holder comprising a first shaft lever, a second shaft lever, a resisting block and a second elastic member;
the resisting block being located adjacent to the first shaft lever;
the second elastic member being fitted on the first shaft lever;
the second elastic member comprising a second fixed end and a second elastic end;
the second fixed end pressing against the main body;
the second elastic end pushing against the resisting block;
the reel being fitted on the second shaft lever;
a second roller; and
the second roller being pivotally set in between the reel and the first roller.

6. The adhesive tape dispenser as claimed in claim 2 comprising:
the main body comprising a first cover, a second cover, a second position-limiting block, a second position-limiting groove, a positioning rod, an intermediate portion and an upper side;
the second position-limiting block being long and arcuate;
the an intermediate portion being located in between the first end and the second end;
the second position-limiting block facing towards the second cover;
the second position-limiting block being located adjacent to the intermediate portion;
the second position-limiting groove being formed on the second position-limiting block;
the second position-limiting groove facing towards the first end;
the positioning rod being inserted into the second position-limiting block;
the positioning rod being located adjacent to the upper side;
the tape holder comprising a position-limiting sheet and a second shaft lever;
the position-limiting sheet corresponding to the second position-limiting groove;
the position-limiting sheet being located adjacent to the second shaft lever;
the position-limiting sheet comprising a notch;
the notch corresponding to the positioning rod; and
the notch being configured to be engaged with the positioning rod for positioning the tape holder.

7. The adhesive tape dispenser as claimed in claim 6 comprising:
the main body comprising a first round rod, a first fixing hole, a second round rod and a second fixing hole;
the first round rod being disposed on the first cover;
the first round rod facing towards the second cover;
the first round rod being located at the second end;
the first fixing hole being formed on the first round rod;
the second round rod being disposed on the second cover;
the second round rod facing towards the first cover;
the second round rod corresponding with the first round rod;
the second round rod being located at the second end;
the second fixing hole being formed on the second round rod;
the second fixing hole corresponding with the first fixing hole;
a holding portion;
the holding portion being secured at the second end;
the holding portion being located in between the first cover and the second cover;
the holding portion comprising a grip, a third insert hole and a fourth insert hole;
the third insert hole being formed on the grip;
the third insert hole corresponding to the first round rod;
the first round rod being inserted into the third insert hole;
the fourth insert hole being formed on the grip;
the fourth insert hole corresponding to the second round rod; and
the second round rod being inserted into the fourth insert hole.

8. The adhesive tape dispenser as claimed in claim 7 comprising:
the second round rod comprising a second rod diameter;
the first round rod comprising a first rod diameter;
the second rod diameter being larger than the first rod diameter;
the main body comprising a recessed groove;
the recessed groove being formed on the second round rod;
the recessed groove corresponding with the first round rod; and
the first round rod being inserted into the recessed groove.

9. The adhesive tape dispenser as claimed in claim 7 comprising:
the holding portion comprising an outer shell;
the outer shell being fitted on the grip;
the outer shell comprising a shell material;
the grip comprising a grip material;
the shell material being different from the grip material; and
the holding portion comprising a bi-colored pattern.

10. The adhesive tape dispenser as claimed in claim 1 comprising:
the electrostatic generating element comprising hair fiber material; and
the hair fiber comprising a predetermined length.

11. The adhesive tape dispenser as claimed in claim 1 comprising:
the electrostatic generating element comprising a Velcro material.

12. The adhesive tape dispenser as claimed in claim 1 comprising:
the electrostatic bearing element comprising a thermoplastic rubber material.

* * * * *